United States Patent [19]

Bruke et al.

[11] 3,944,127

[45] Mar. 16, 1976

[54] DISPENSING CARTON HAVING A BAG-LIKE LINER

[75] Inventors: Richard Leroy Bruke; Lars Göran Larsson, both of Malmo, Sweden

[73] Assignee: Aktiebolaget Platmanufaktur, Malmo, Sweden

[22] Filed: Sept. 11, 1974

[21] Appl. No.: 504,852

[30] Foreign Application Priority Data

Sept. 18, 1973 Sweden ..... 7312683
Sept. 18, 1973 Sweden ..... 7312684

[52] U.S. Cl. ..... 229/14 B; 229/7 R; 229/17 R
[51] Int. Cl.[2] ..... B65D 5/56; B65D 25/16
[58] Field of Search ..... 229/14 B, 14 BA, 14 BE, 229/14 BW, 14 C, 7, 17

[56] References Cited

UNITED STATES PATENTS

| | | | |
|---|---|---|---|
| 2,361,408 | 10/1944 | Moore | 229/17 R X |
| 2,434,756 | 1/1948 | Brooks | 229/17 R X |
| 3,029,008 | 4/1962 | Membrino | 229/14 B |
| 3,149,768 | 9/1964 | Aller | 229/14 C |
| 3,387,764 | 6/1968 | Forrest | 229/14 BA X |
| 3,506,180 | 4/1970 | Forrest | 229/14 B |
| 3,768,719 | 10/1973 | Johnson | 229/14 B |

*Primary Examiner*—Davis T. Moorhead
*Attorney, Agent, or Firm*—Hane, Baxley & Spiecens

[57] ABSTRACT

There is disclosed a package or wrapping for powderized material such as ground coffee. The package consists of a substantially rigid outer casing and an inner container or liner made of plastic or other flexible material. The goods to be packaged are placed in the inner container, the shape of which is so that it substantially fits the casing when filled. The casing has on one side an opening which can be closed by a cover and the inner container when placed in the casing has on its side facing the casing opening a flat closure. The container is secured to the casing along its edges adjacent to the container opening. The fastening is of the type which can be ruptured, for instance, by means of a tear strip secured to the material of which the container closure is formed.

9 Claims, 29 Drawing Figures

Figure 1:
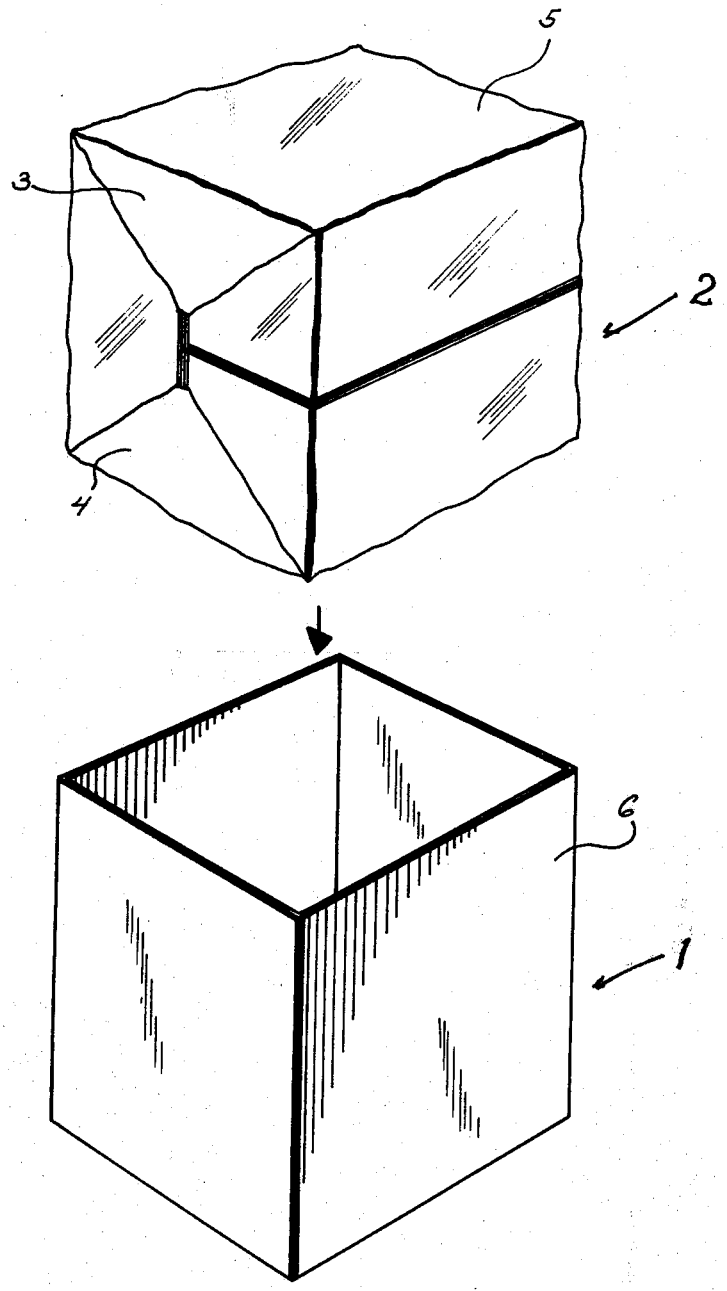

FIG. 4
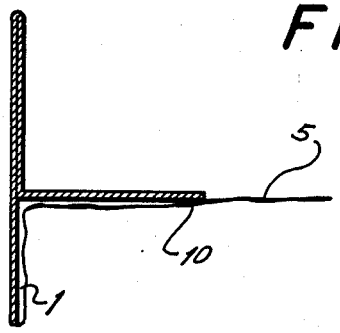
FIG. 5
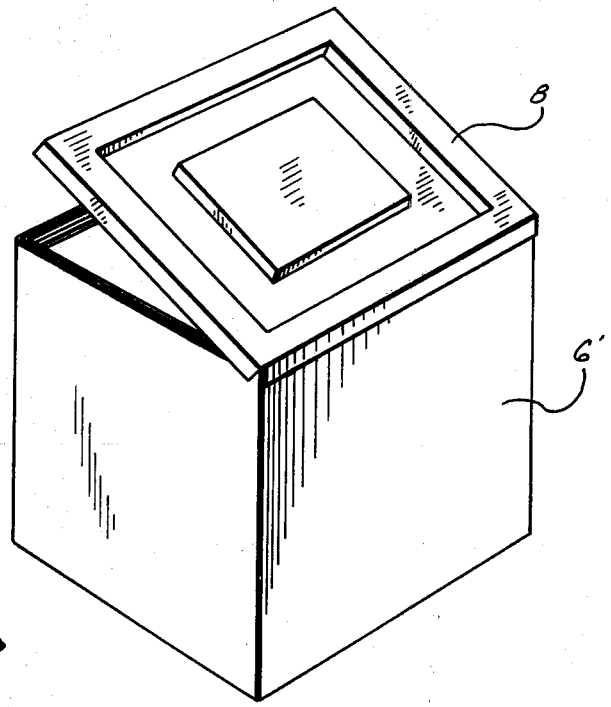
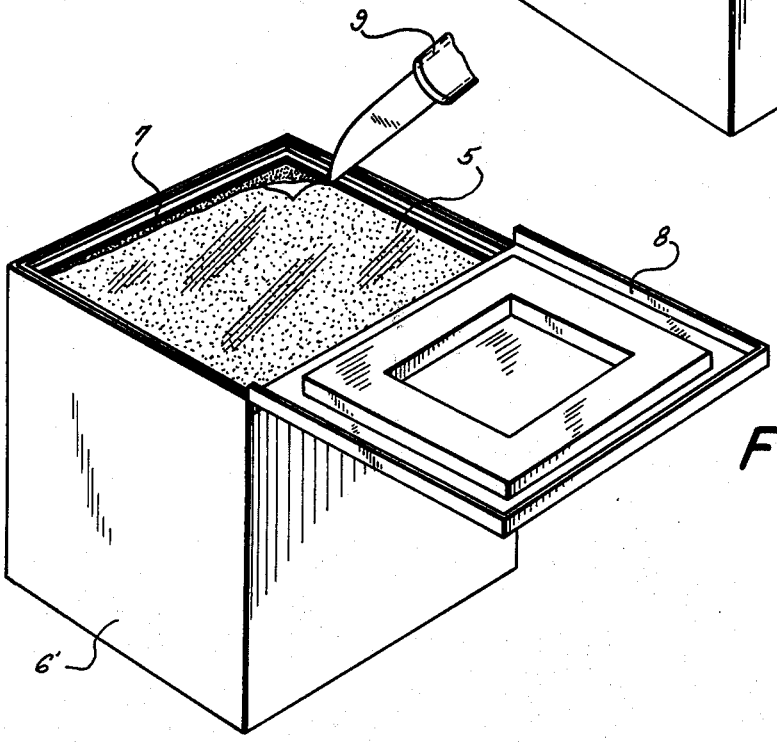
FIG. 6

FIG. 9
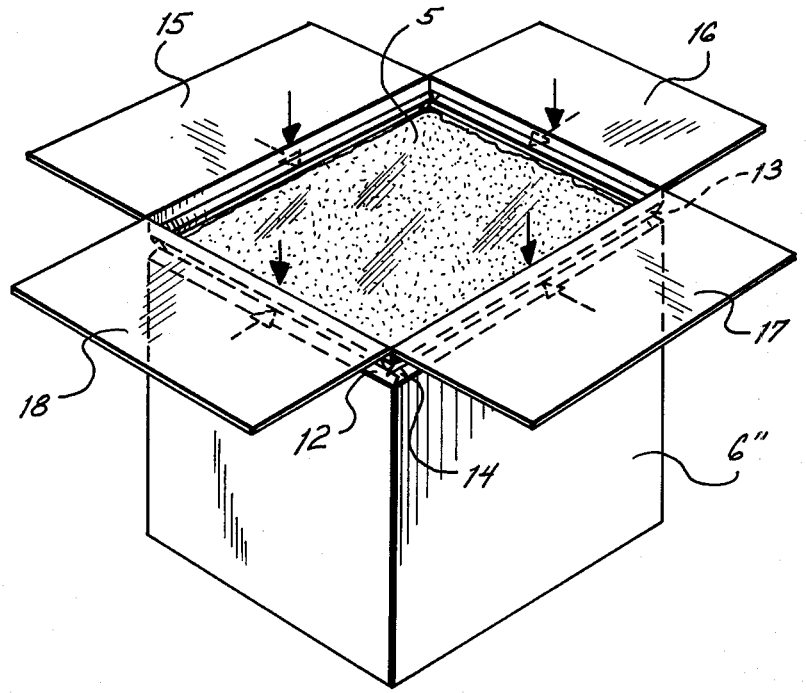
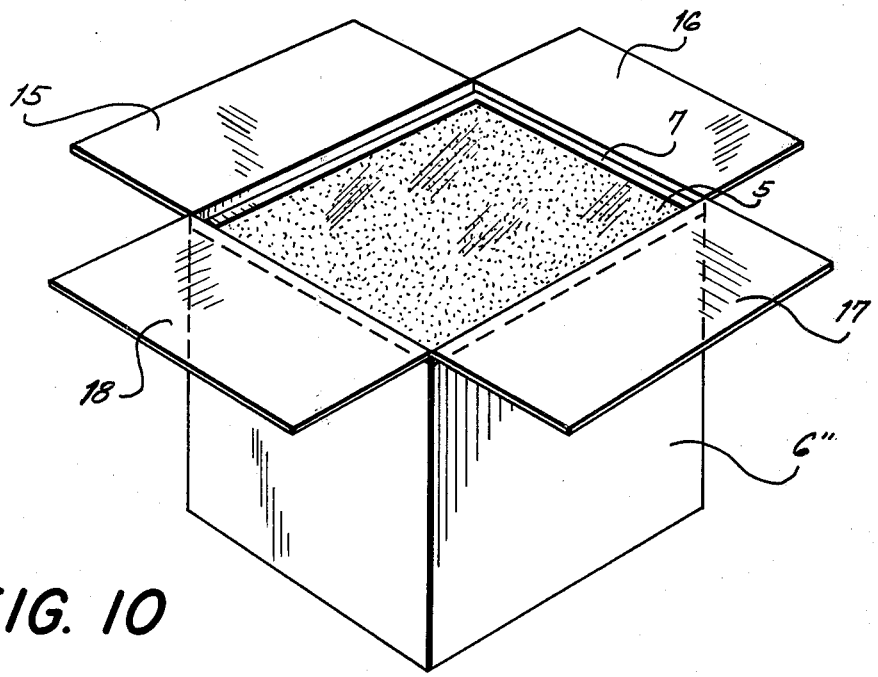
FIG. 10

FIG. 12
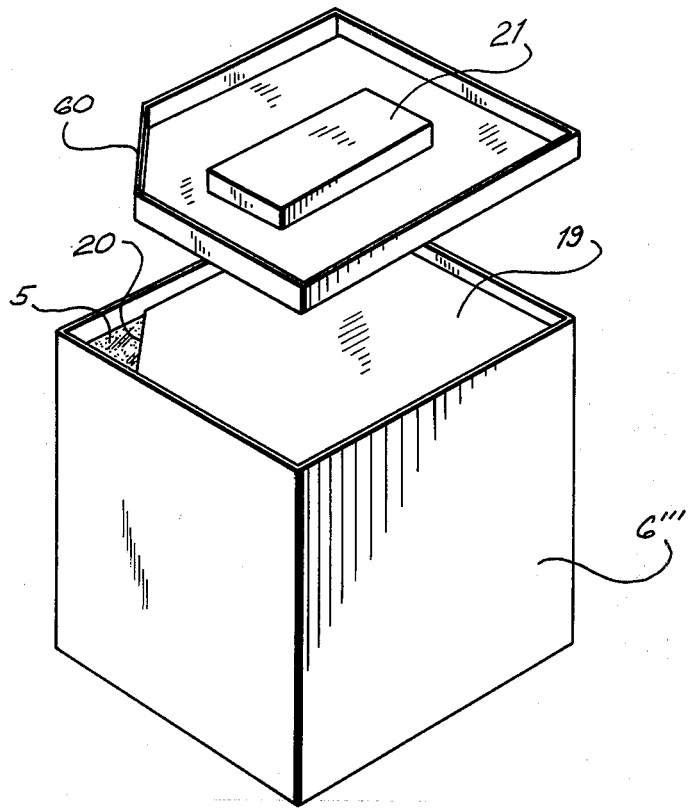
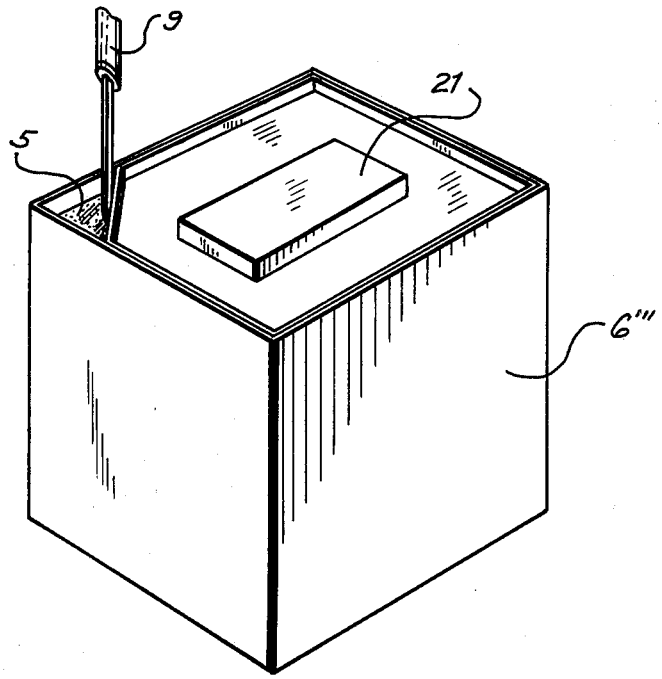
FIG. 13

FIG. 16
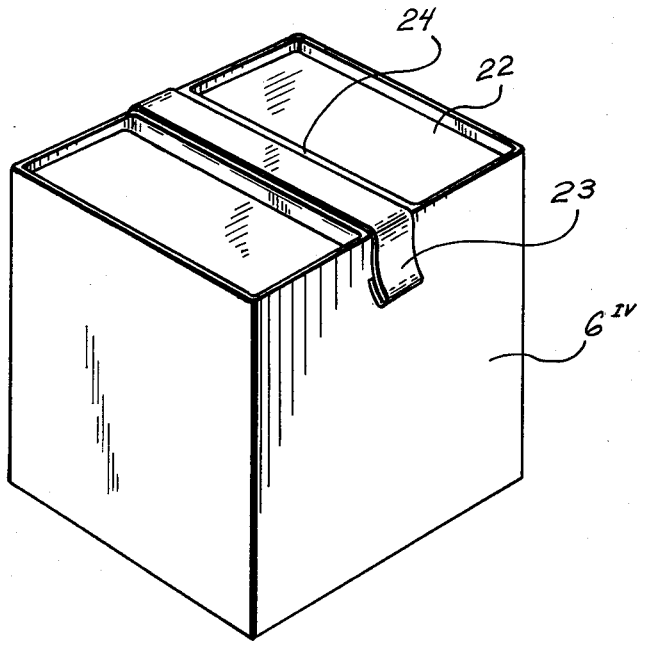
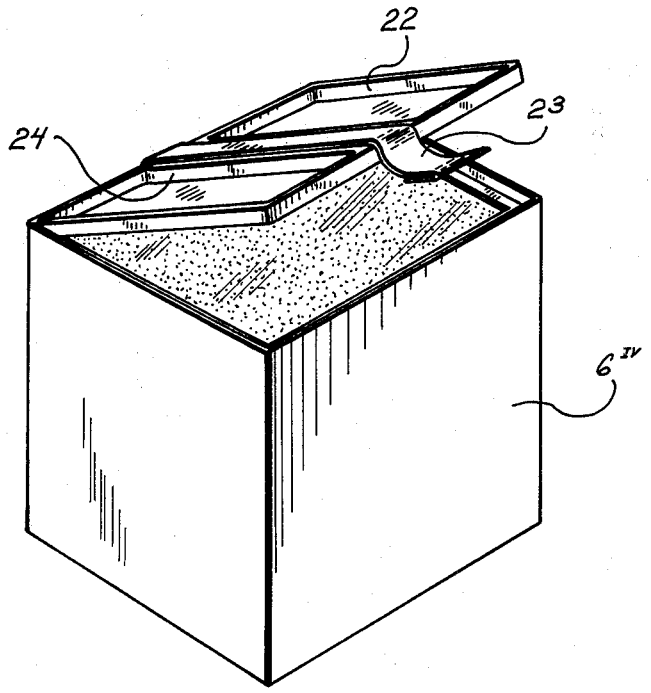
FIG. 17

FIG. 18
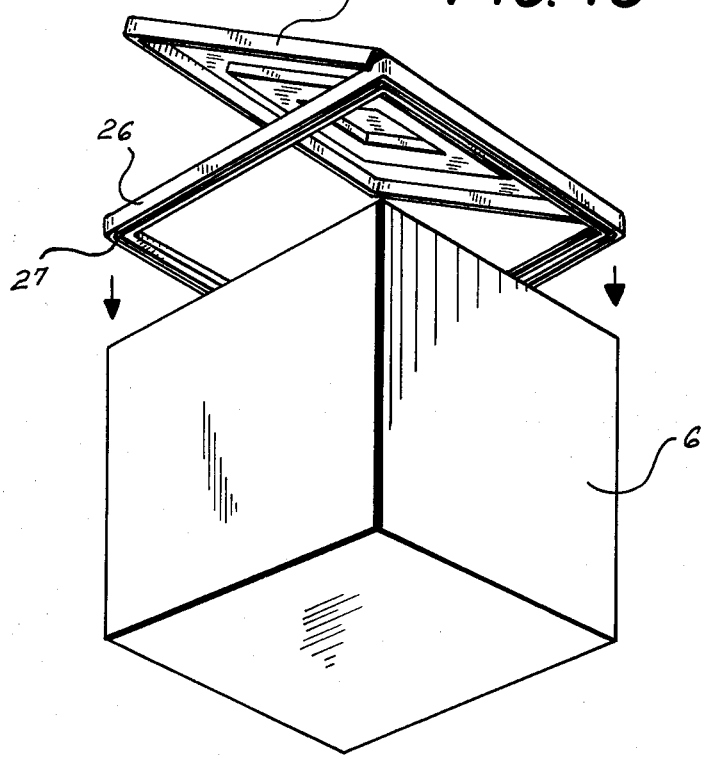
FIG. 20
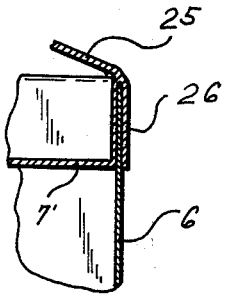
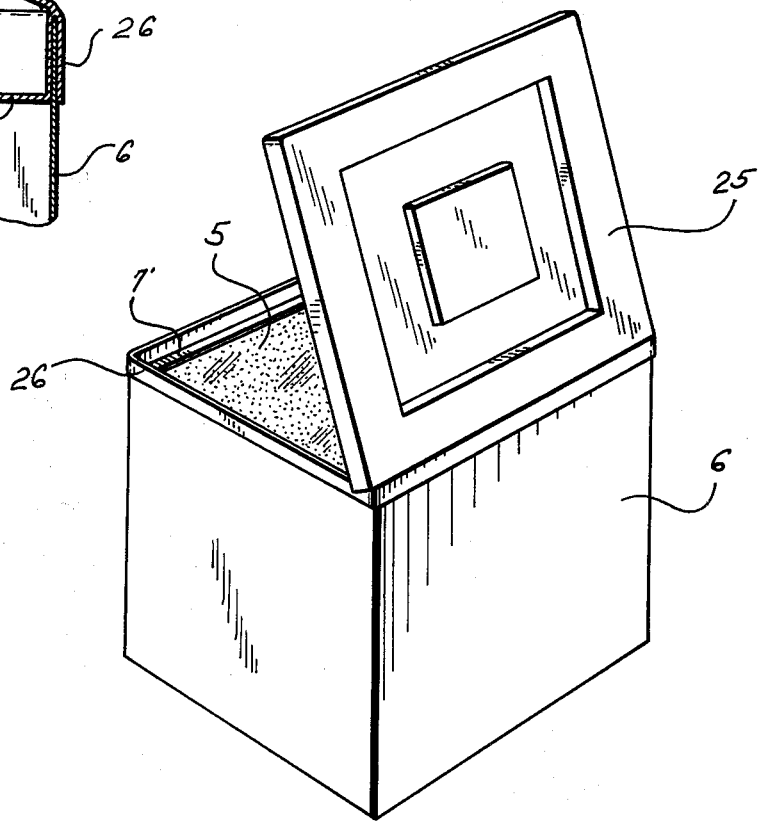
FIG. 19

DISPENSING CARTON HAVING A BAG-LIKE LINER

The present invention is to provide a wrapping of the type which has an outer supporting casing and placed therein a container made of flexible material and which is particularly intended for pulverized, liquid, semi-solid and solid goods.

As a wrapping for the above-mentioned goods, according to known technology, among others, a combination of a rigid outer casing and an inner container made of foil material has been used. The inner container has been placed loosely in the outer casing. With this type of wrapping, certain difficulties are involved in emptying the contents from the inner container. These difficulties arise regardless of whether the inner container, when being emptied, remains in its outer casing or if it is removed from same.

When the inner container is being filled, a rather hard vacuum is often used. Evacuation subjects the plastic films to heavy stresses, which is liable to cause pinholes to occur, particularly if the enclosed goods have sharp edges, e.g. if they consist of particles of coffee. It is moreover difficult to make the weld seams sufficiently tight to completely withstand the forces to which they are subjected by the hard evacuation. It is obvious that air will leak into the wrapping and fill this completely, if a hole, regardless of how small it may be, should be made in the material that encloses the goods. This involves a risk that the enclosed goods will be spoiled. If they consist of e.g. coffee, the quality will deterioriate considerably after only a week or so.

Sometimes inner containers are used which are not filled under vacuum. A container filled in this way will usually be difficult to handle and to place in its outer casing. It is moreover difficult to achieve that the inner container fills up the outer casing completely. The purchaser will thereby be misled as regards the quantity in the wrapping.

The above-mentioned two types of wrappings with separate containers have the drawback that it is not possible to empty a certain quantity out of the wrapping and thereafter close it again, but the entire contents must be transferred to another container, which can be closed.

It is also possible to use wrappings which have a rigid outer casing, which is lined with a container made of flexible material. As a rule, such a container is closed by means of certain folding of flaps, and is difficult to open, and which, once it has been opened, is possible to close, but not tightly, which involves that if the goods in the wrapping have a certain aroma, this can be lost in the remaining quantity in the wrapping when this has been opened and a certain quantity has been removed.

The purpose of the present invention is to provide a wrapping of the type which has an outer supporting casing with an internally fixed container made of flexible material. It is thereby possible to use a cheap material for the outer, supporting casing, while the use of the material which produces the necessary barrier and is accordingly more expensive, can be limited to the inner container. Through the build-up of the wrapping, the quantity of the more expensive material used can be reduced considerably.

A wrapping made in accordance with the invention has the favourable properties of a can when being handled. It is just as easy to empty out of and re-close as a can of the type from which a cover is removed by its being torn open and which is closed with the aid of a plastic cover. These properties are achieved according to the present invention in that a smooth surface — one having no joints and seams — of the inner container serves as a cover of the composite wrapping and in that the smooth surface is located at the part of the outer wrapping which is to function as the opening for emptying out contents. The inner container is fastened at this opening of the outer casing, and then particularly in such a way that when the wrapping has been emptied, the outer casing and the inner container can easily be separated from each other.

If the inner container should be filled with goods of such a kind that an increase in pressure can arise in the sealed wrapping, the wrapping can be provided e.g. in its seams with one or several one-way valves, made of e.g. organic material. If a a release of gas takes place in the wrapping this gas can thereby leave the wrapping while, on the other hand, gas cannot flow into the wrapping. These valves thus co-operate towards a one-way equalization of pressure between the inner space in the inner container and its surroundings.

Said valves can coact with one or several closed spaces outside of the space for the goods, in order to collect particles, if any, of the goods enclosed in the inner container, which particles can undesirably endeavour to go through a valve. If particles then become jammed in the valve, the function of the valve can cease, and with the designs now available, it will usually remain in an open position. A valve suitable for use in this connection is described in the Swedish patent application No. 7405612-8.

In certain applications, e.g. when the wrapping is used for storage of coffee, the need for valves can be avoided by the goods being kept in intermediate storage for such a long time that the goods are degassed to a sufficient extent so that overpressure will be avoided in the filled and sealed wrapping during the storage of the filled wrapping. This can possible be combined with a light evacuation of the inner container before this is sealed.

The wall part of the inner container which serves to obtain as an opening can be provided with sections to facilitate its being torn off. These sections can also serve as an indication for a cutting implement for cutting away the cover panel made of flexible material which is located below. This material can then be partly fastened to the well part of the outer container which is to be removed. Once the wrapping has been opened, a closable cover can be placed over the opening, so that the wrapping can be emptied as required.

The wrapping can be strictly parallelepipedical, and one wall side can then constitute the opening of the wrapping, and the inner container is then fastened at the mouth of the opening in such a way that the smooth surface forms a cover panel at this mouth and can easily be cut away with a knife. When the wrapping is emptied in portions, it can be combined with a cover made of e.g. plastic, which tightly seals the wrapping, so that its contents will not be spoiled. In a wrapping of the last-mentioned kind, it is assumed that the parallelepipedical wrapping, viewed from its mouth, has entirely smooth walls internally. The wrapping can, of course, also be provided with a peripheral flange, directed inwards, at its mouth. The smooth surface of the inner container can then be fastened to the under side of the peripheral flange.

It is thus characteristic of the invention to form an easily opened cover panel of the wall of the container. In such a wrapping it is also a characteristic property according to the invention that the inner container has been filled before it is placed in the outer wrapping in such a way that the filled-in goods substantially fill up the entire volume of the inner container. This reduces material required for the inner container which, because of the special requirements, e.g. for barrier properties, is usually made of comparatively expensive material. It is also characteristic for the invention that the geometric shape of the inner container conforms comparatively well to the geometric shape of the outer casing.

In order to obtain a substantially inflexible wrapping, in a wrapping according to the invention, if it is appropriate with consideration to the goods enclosed, compression and/or evacuation can be employed to a varying degree. This gives the inner wrapping a stable form. This modification of the treatment of the inner wrapping with its contents is appropriate for the storage of e.g. coffee. If protective gas is used, the inner wrapping will, of course, be less inflexible. According to the invention a folding and/or a sealing procedure is used in connection with the sealing of the wrapping, which also when protective gas is used gives comparatively good conformity between the shape of the inner container and the shape of the outer casing.

The inner container according to the invention appropriately has a tubular shape when it is filled with goods, and it is thereafter sealed with the aid of an appropriate device so that the filled up inner container will obtain substantially the same geometric shape as the outer casing.

A very characteristic property of the present invention is that the inner container and the outer casing are fastened together in such a way that when the wrapping has been emptied the inner container made of flexible material can easily be separated from the outer casing made of rigid material. This substantially facilitates the recycling of the material, since the different kinds of material can easily be separated from each other. The actual fastening takes place along a closed line of the width desired, continuously or discontinuously. The inner container can be utilized for goods of various kinds, such as liquids for instance beer, milk or carbonated beverages, semi-solid goods such as butter, and pulverized goods such as coffee, tea, sugar and flour.

Figure 2:
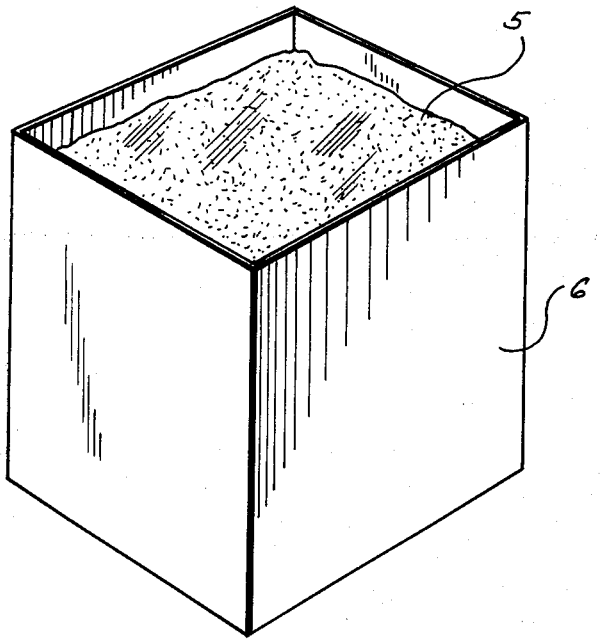
Figure 3:
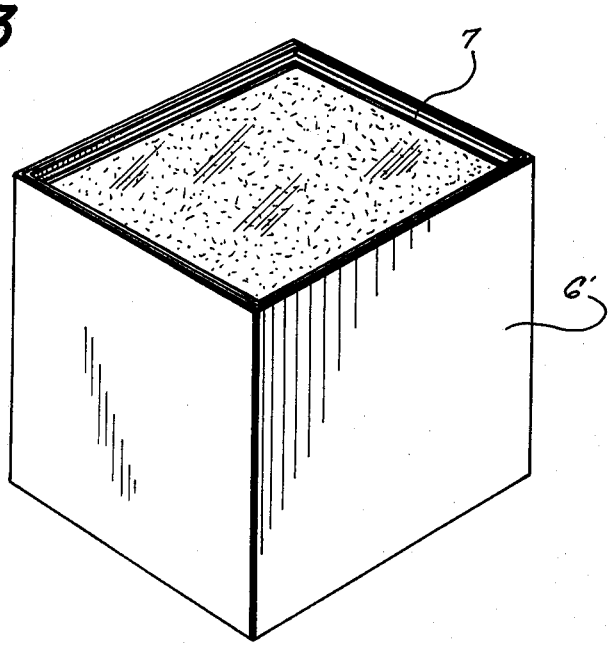
Figure 7:
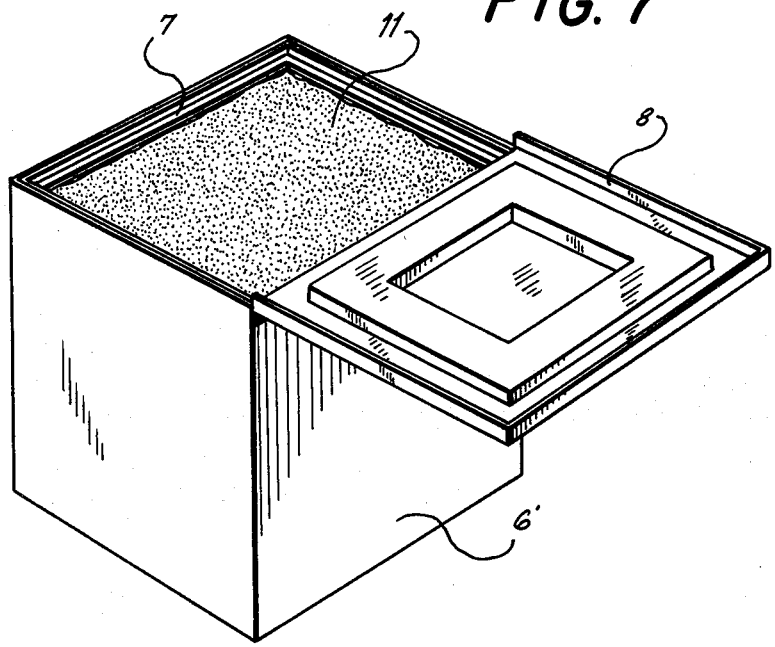
Figure 8:
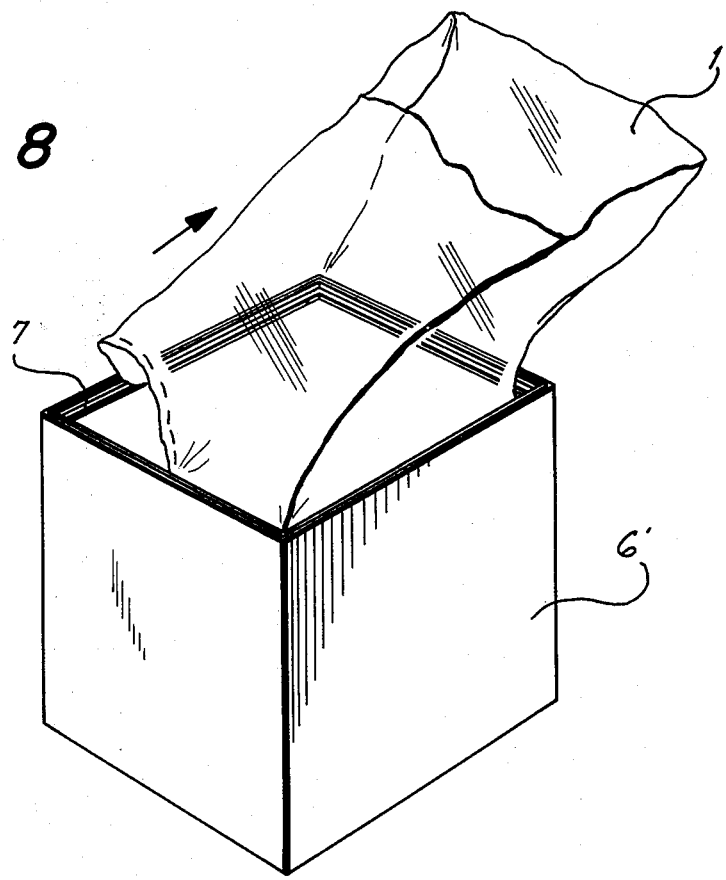
Figure 11:
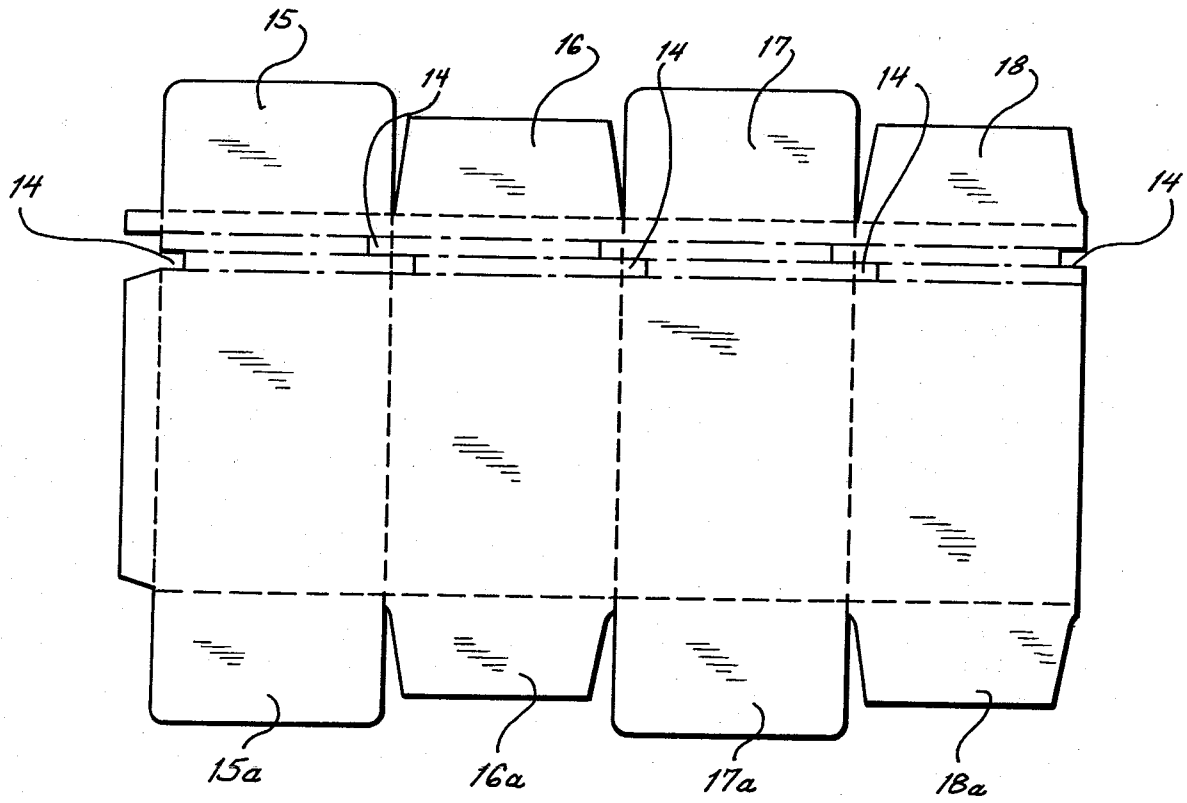
Figure 14:
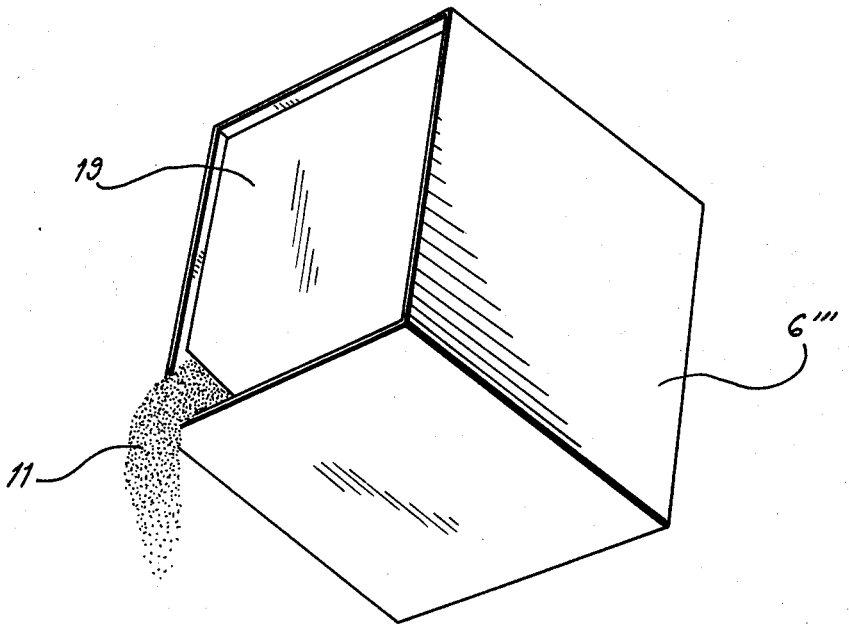
Figure 15:
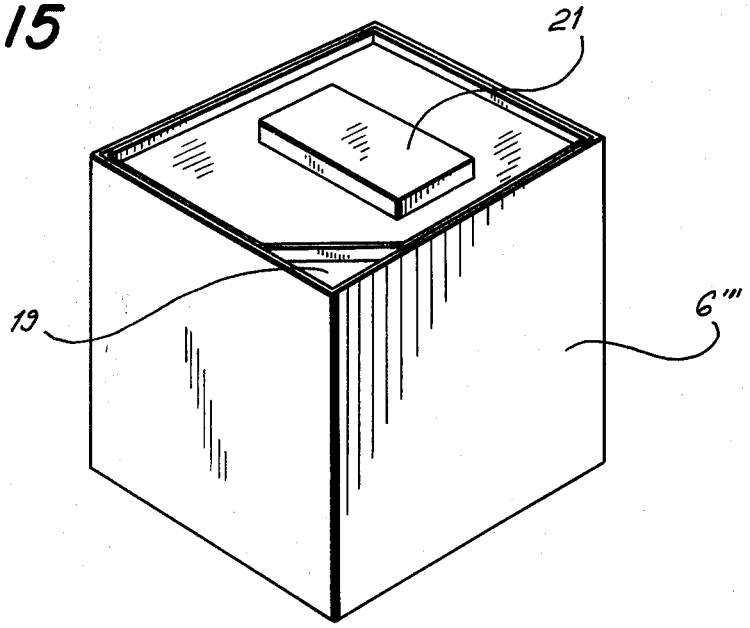
Figure 21:
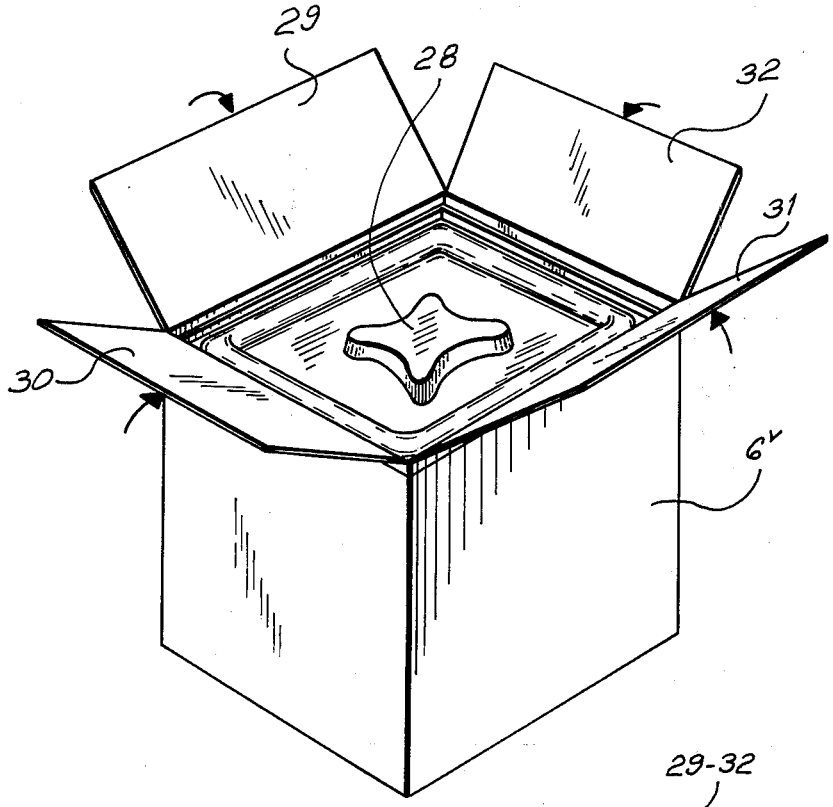
Figure 22:
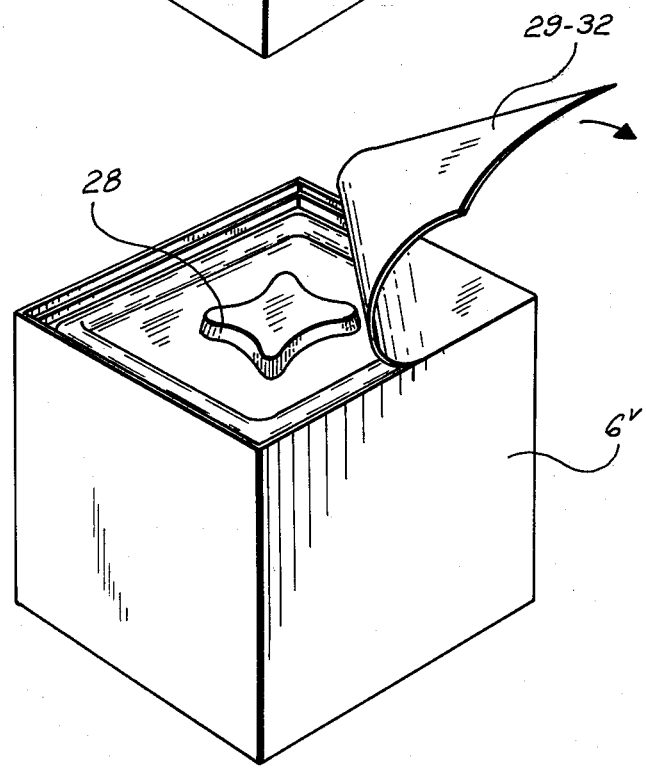
Figure 23:
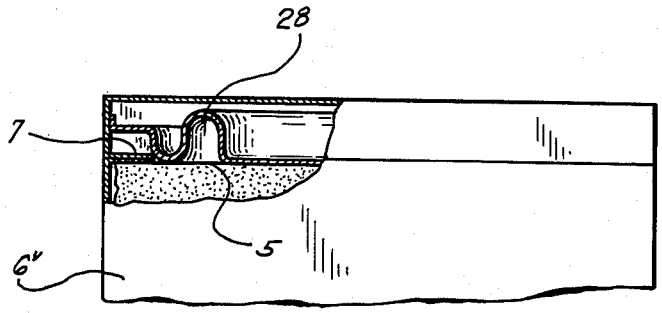
Figure 24:
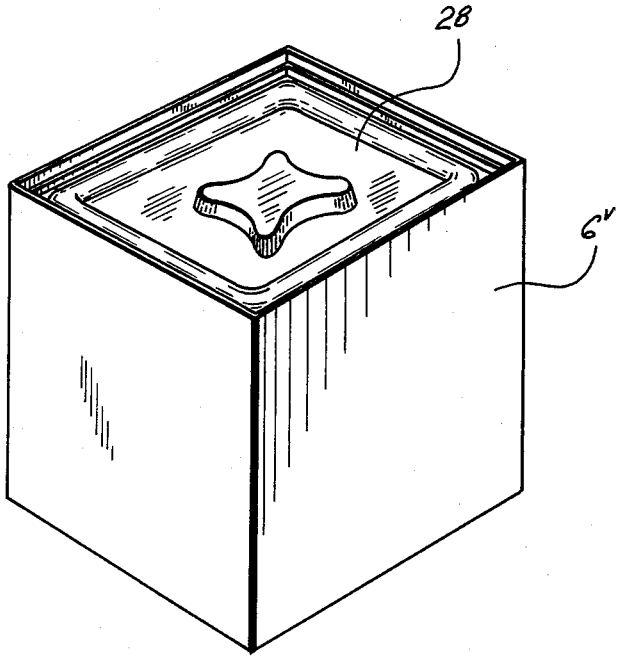
Figure 25:
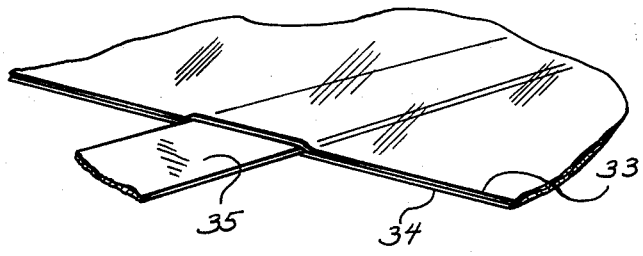
Figure 26:
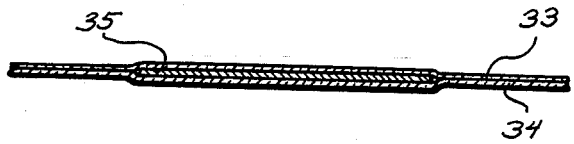
Figure 27:
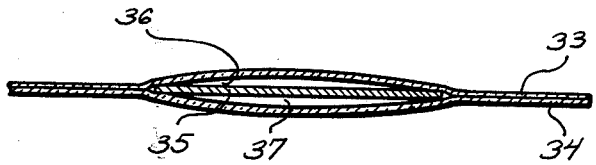
Figure 28:
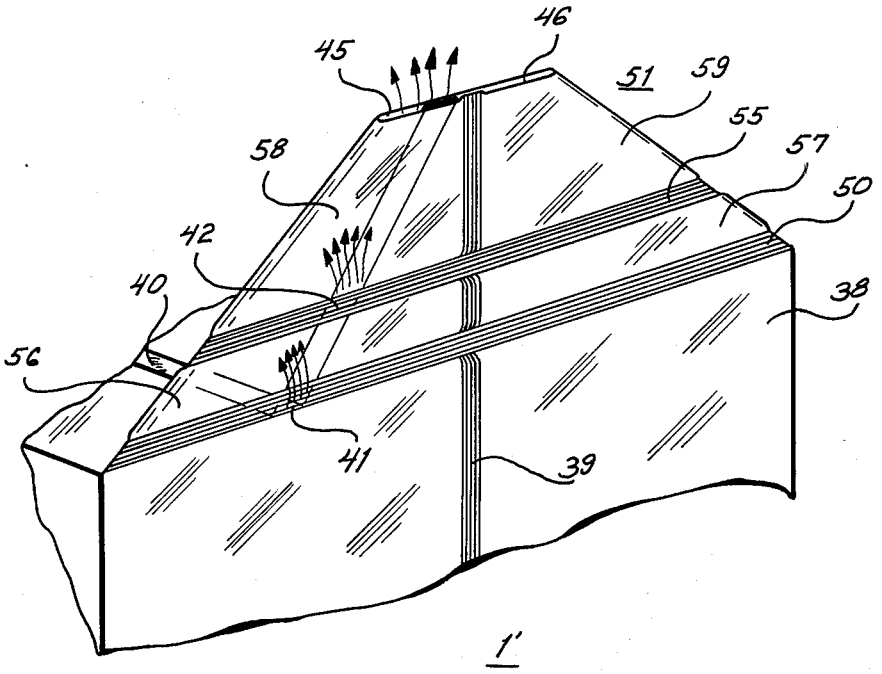
Figure 29:
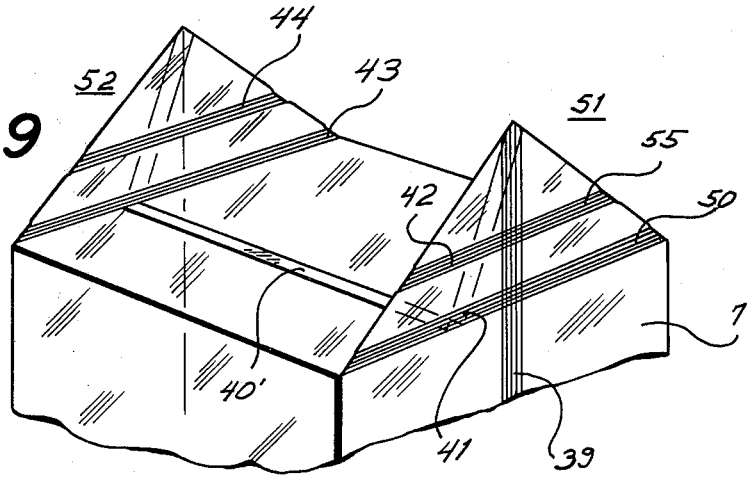

The present invention will be described in more detail with reference to the attached drawings, in which FIG. 1 shows an exploded perspective view of a parallelepipedical outer casing and a likewise parallelepipedical member consisting of an inner casing made of flexible material, for example plastic, aluminium or the like, and containing filled-in goods, which member is intended to be placed in the first-mentioned outer casing, FIG. 2 shows said member placed in the outer casing and with a cover panel made of flexible material, FIG. 3 shows a modification of the wrapping according to FIG. 2, FIG. 4 shows how the inner casing for said member is fastened to the outer casing of the wrapping according to FIG. 3, FIG. 5 shows the wrapping according to FIG. 3 provided with a cover for closing same, FIG. 6 shows the removal of the cover panel according to FIG. 5, FIG. 7 shows the wrapping according to FIG. 6 but with the cover panel removed, FIG. 8 shows how the inner container can be removed from the outer casing of an emptied wrapping, FIG. 9 shows an outer casing with an inner container with filled-in goods, the flange of the outer casing which is directed inwards in the process of being formed, and consisting of parts of the wall of the outer casing, FIG. 10 shows the wrapping according to FIG. 9 with the peripheral flange completely formed, FIG. 11 shows the blank for the outer casing according to FIG. 9 and 10, FIG. 12 shows a wrapping with a depressed inner container and where the open surface of the inner container to a major extent is covered by rigid well material and where a cover is arranged which can be placed in two positions, viz. a position covering the opening and a position uncovering the opening, FIG. 13 whows the wrapping according to FIG. 12 with the cover in the uncovering position and where a cover panel located under the opening is being cut, FIG. 14 shows how the wrapping according to FIGS. 12 and 13 is being emptied, FIG. 15 shows the wrapping according to FIGS. 12–14 with the cover put on, covering the opening, FIGS. 16 and 17 show a parallelepipedical wrapping, in which the outer casing has a peripheral flange, directed inwards with which a depressed cover coacts, which has a strip-formed member that functions as a hinge and also as a cover, FIGS. 18 and 19 show in two different situations a parallelepipedical wrapping according to FIG. 3 with a closing unit consisting of edge frame, flange and cover, FIG. 20 shows the fastening of the edge frame, FIGS. 21, 22, 23 and 24 show in different situations a wrapping according to FIG. 3 with a cover which is applied to the peripheral flange, achieving sealing, FIGS. 25, 26, and 27 show the principle of a one-way valve comprised in the wrapping, FIG. 28 shows a parallelepipedical inner container provided with closed spaces outside the space containing the goods, which closed spaces function as pockets for collecting particles from the space containing the goods, and FIG. 29 shows a more complete view of the inner container shown in FIG. 28.

FIG. 1 shows a parallelepipedical inner container 1 made of flexible material, which is filled with appropriate goods, for example milk, butter, sugar, coffee, tea or the like. Appropriate material for the inner container is a multi-layer plastic foil. An example of such a foil is a five-ply foil with a center layer of polyvinylidene chloride and outer layers of polyethylene and intermediate layers of ethylene vinyl acetate. Appropriate values of the thickness of the container wall using a foil built up in this way vary between 50 $\mu$m and 200 $\mu$m. In one example of the embodiment a film with a thickness of 100 $\mu$m has been used. The foil has the properties that it prevents for example oxygen or water vapor from the outer atmosphere from entering, at the same time as the flavor elements are retained inside of the wrapping. With the thickness of 100 $\mu$m the following barrier properties have been measured as regards the gas transmission:

Water vapour 2.3g/m$^2$/24 hr at 38°C 95% RH or 0.15 g/100 sq.in./24 hr at 100° F 95% RH Oxygen
7.0 cc/m²/24 hr/atm at 24°C or
0.45 cc/100 sq.in./24 hr/atm at 75°F
Carbon dioxide
19.5 cc/m²/24 hr/atm at 24° C or
1.26 cc/100 sq.in./24 hr/atm at 75° F
Nitrogen
0.9 cc/m²/24 hr/atm at 24°C or
0.06 cc/100 sq.in./24 hr/atm at 75°F Other materials for the inner container are paper, plastic and metal, and combinations of these. When the inner container is being filled, from the beginning it should appropriately have the form of an open tube, which is thereafter closed so that the container will obtain the form shown in the figure. The closing should moreover take place in such a way that the closed inner container will tend to retain the form obtained, which fits well into the outer casing. If the container is filled with a pulverized material which, when appropriate, is compressed and/or evacuated, a rigid and inflexible member is obtained. It is a characteristic that the inner container is always well filled.

If a tubular material is used, this will have a longitudinal weld, and this is shown in FIG. 1 with the reference designation 2. If the tube is extruded, it will not have any longitudinal weld. The material should appropriately be closed at its ends with the aid of heat sealing and by flaps 3 and 4. The container can be filled using an inert gas or with a product which emits gas. At the joints or seams of the container it is possible to place one-way valves, so-called ribbon valves, made of organic material, which have the capability of letting out gas from the container but do not let in gas. The flaps of the container can also be formed in such a way that they create pockets for collecting particles that are carried by the gases through the valves when the gas pressure in the container is too high. The purpose of the pockets is to prevent particles from trying to escape through the one-way valves into the environment of the container. The container can also be made of paper sheets, metal or other appropriate material, or combinations thereof. The container also has a smooth rectangular surface 5, and the container has been given exactly the same geometric dimension as an outer supporting casing 6. The container 1 is placed in this supporting casing, and this forms a combination wrapping consisting of an outer, rigid casing and an inner container made of flexible material. The outer supporting casing 6 can be made of any appropriate material whatsoever, e.g. cardboard, paper, wood, metal, plastic and other materials, and combinations thereof. The casing should be of such a nature that it does not constitute a weak or unsteady wrapping. The thickness of the outer casing should be adapted to the nature of the filled-in product and external requirements for the stability of the wrapping. The parallelepipedical member 1 made of elastic material is fastened around its periphery at the wall part 5 to the inner wall of the casing 6, and then along a narrow strip around the mouth of the casing. The adhesion between the material in the container 1 and the casing 6 should be such that a stable cover panel is formed by the side wall 5 in the container 1. When the wrapping has been emptied, the adhesion should be such that the inner container can easily be separated from the supporting casing. FIG. 2 shows the container inserted in the supporting casing 6.

FIG. 3 shows a wrapping of the same kind as the one shown in FIG. 2, but with the difference that the outer casing, at its opening, has been provided with a peripheral edging strip 7. The container 1 is fastened to the bottom edge of this strip. The way in which the fastening is effected is clearly shown at 10 in FIG. 4.

FIG. 5 shows the wrapping according to FIG. 3 provided with a cover 8, which can tightly close the opening of the outer casing 6' so that a tight sealing is obtained. The cover should appropriately be made of plastic or cardboard.

The wrapping described in the foregoing according to FIGS. 2, 3 and 5 function in the following way. The container 1 is placed in the casing 6 or 6', as previously described, and the side 5 of the container then functions as a cover panel for the combination wrapping. The container 1 is fastened continuously or discontinuously to the outer casing 6 as well as 6' along a peripheral strip in said outer casing. When the wrapping according to FIGS. 2, 3 or 5 is to be opened, a cut is made along the periphery of the cover panel with a knife 9, so that the cover panel made of flexible material is cut away. This is clearly shown in FIG. 6. When the cover panel 5 has been removed, the desired quantity of goods 11 can be removed from the wrapping, which can thereafter be closed with the aid of the cover 8 — see e.g. FIG. 7. When the wrapping has been emptied entirely, the inner container can easily be torn loose from the outer casing 6 or 6', since it has only been fastened along a peripheral strip. This is shown in FIG. 8. At the separation the materials can be sorted up for recycling.

FIG. 9 shows a parallelepipedical wrapping 6'', of which the wall parts 12 and 13 of the wall of the outer casing 6'' are being folded in to form a peripheral flange 7. At the ends of the wall parts, notches 14 in the outer casing 6'' prevent overlapping wall material. The peripheral flange 7 which is formed will thus consist of two wall parts 12 and 13, one located over the other, as shown in FIGS. 9 and 10. The open smooth surface 5 of the container 1 is fastened to the wall part 12 in the way shown in FIG. 4. The outer casing 6'' is provided with four cover flaps 15, 16, 17 and 18, for closing of the wrapping. FIG. 11 shows the blank for the outer casing 6'' with its flaps 15, 16, 17 and 18, **15*a*, 16*a*, 17*a* and 18*a*, and the notches 14**.

FIGS. 12–15 show a parallelepipedical wrapping 6'''. The smooth surface 5 of the inner container 1 is depressed somewhat below the opening edge of the outer casing 6'''. The major portion of the smooth surface 5 of the inner container 1 is covered with an upper part 19 made of rigid material, which can be fastened to the envelope surface of the outer casing 6'''. The upper part 19 has such a shape that it exposes a triangular surface 20. At this surface 20 the smooth surface 5 of the inner container 1 is laid open. The wrapping has a cover 21 made of e.g. plastic, which can be set down into the opening formed by the mouth edge and the upper part 19 of the outer casing 6'''. The cover has a cut-off corner 60, which conforms to the opening 20. This is clearly shown in FIG. 12, in which both the cut-off corner 60 and the edge of the upper part 19 coincide at the opening 20 and form a support for the removal of the wall part 5 of the inner container 1 which has been laid open, by means of a knife 9. When the wall part 5 has been removed, the desired quantity can be emptied out of the wrapping with the cover 21 put on or removed (see FIGS. 12 or 14). The wrapping can thereafter be closed, as shown by FIG. 15, by turning the cover through a ¼, ½ or ¾ turn in relation to the position shown in FIG. 12.

FIG. 16 shows an outer casing of the same kind as the one shown in FIG. 3. The outer casing has the reference designation $6^{IV}$. In the space formed above the surface 5 of the inner container and the peripheral edge strip a sealing cover 22 is arranged, which has a peripheral wall directed upwards and a bottom. In the middle of the cover a raised portion 24 is arranged which, when the cover is on, coincides with the edge of the opening of the outer casing $6^{IV}$. On the cover a ribbon 23 is fastened, which has one end firmly attached to one side wall of the outer casing $6^{IV}$ and one end for coaction with the opposite wall of the outer casing. This last-mentioned end can be put into and out of contact with the wall and thereby functions as a locking device. The first-mentioned end of the ribbon 23 functions as a hinge. The functioning of the two ends of the band is clearly shown in FIG. 17.

FIGS. 18 and 19 show a wrapping according to FIG. 2. The outer casing has the reference designation 6. Coacting with the outer casing there is a cover 25, fastened to a peripheral edge frame 26, which has a peripheral groove 27. The edge at the opening of the outer casing 6 can to be inserted into groove 16. The groove 27 can appropriately contain an adhesive, so that an edge frame mounted on it will remain in place on the outer casing 6. The edge frame 26 is provided with a peripheral flange 7′, and the edge frame 26 with flange 7′ and the cover 25 are appropriately made in one cohesive unit, and consist of e.g. plastic. The cover 25 has one side fastened to the edge frame 26 in such a way that a hinge function arises. A put on cover with edge frame is clearly shown in FIG. 19, and FIG. 20 shows in more detail how the edge of the opening of the outer casing is inserted in the groove 27.

FIGS. 21, 22, 23 and 24 show a wrapping according to FIG. 3 on which, however, the wrapping has flaps 29, 30, 31 and 32 at its edge for closing the outer casing, which has been given the reference designation $6^{V}$. A plastic cover 28 or a cover made of some other material is placed on the surface 5 of the inner container. Parts of the cover, located inside its outer edge, can be bent in as shown in the figure.

Wrappings of the last-mentioned kind are utilized in the following way. First a filled inner container is placed in the outer casing $6^{V}$ and it is also fastened to the outer casing $6^{V}$, and then appropriately under the peripheral flange 7 (see FIGS. 7 and 8). When this has been done, the cover 28 is placed on the surface 5 of the container 1. Thereafter the wrapping is closed with the aid of the flaps 29, 30, 31 and 32. The wrapping is now ready for sale. To open the wrapping, a person opening the wrapping first tears off the top layer formed by the flaps 29 and 32. He thereafter lifts off the cover 28 and cuts out the cover panel which is formed by the smooth surface 5 of the inner container. The desired quantity of goods can then be removed from the wrapping and when this has been done, the cover can be replaced, forming a seal, and its outer edge will then be in contact with the flange 7. The principle of a one-way valve other than the valve according to the previously mentioned in Swedish patent application No. 7405612-8 is shown in FIGS. 25–27, which show two layers of foil 33 and 34 in contact with each other, the outer edges of which are intended to be welded or made to adhere to each other. The two layers of foil 33 and 34 can be comprised in an inner container. Between the two layers 33 and 34 a central member 35 is placed, which has a rectangular cross-section. This member can, of course, have any cross-sectional surface whatsoever, and can thus be e.g. circular. The choice of material in the layer of foil and the central member as well as the adhesion should be such that between the central member and the layer of foil a narrow space can arise, which can have the nature of a peripheral ring or several spaces. This peripheral ring space or spaces can arise if the layers 33 and 34 are comprised in a closed container in which there is a higher pressure than in its surroundings. The space or spaces are to be closed as soon as the higher pressure has been equalized. The central member 35 and the parts of the layers 33 and 34 which coact with it function as a one-way valve. FIG. 26 shows more clearly a closed one-way valve according to FIG. 25, and in FIG. 27 the same one-way valve is shown open, two narrow spaces 36 and 37 then being formed.

It is appropriate to have the material comprised in said one-way valve consist of plastic and the surface of the central member and the opposite surfaces of the layers of foil are then to be of different material. The adhesion between the layer of foil and the central member can then be achieved by means of an adhesive agent or by welding. Appropriate material for the central member is e.g. polyvinylidene chloride. The two layers 33 and 34 can consist of e.g. a plastic foil which has a central layer of polyvinylidene chloride and an outer layer of polyethylene and an intermediate layer of ethylene vinyl acetate. However, it should be obvious that the material in the central member and the layers can be chosen within wide limits, provided that one-way valves are obtained. The adhesion between the layers of foil should be stronger than between the layer of foil and the central member. The central member can also consist of a laminate in which one of the outer layers can be made of the same kind of material as the layers of foil.

FIG. 28 shows a part of a parallelepipedical inner container 1′ which is formed of a layer of film 38, which has first been formed into a tube with the aid of a longitudinal weld. The container has been formed so that it has become parallelepipedical, and this has been done inter alia with the aid of a seal 39 and an edge seal 50. There are corresponding seals along three more edges. In this way, in a known manner, four flaps 51, 52, 53 and 54 are formed in the wrapping. These flaps are folded double, and contain layers of foil material, one on the other. Through a seal 55 parallel to the seal 50 on the flap 51, enclosed spaces 56 and 57 and also spaces 58 and 59 will be obtained which are in contact with the outer side of the container. A central member in the form of a strip 40 is laid through the seal 50 and the seal 55, whereby passage places 41 and 42 are obtained. The central strip 40 is of the same kind as the central strip 35. Further central strips can be laid through the welds 50 and 55. At the passage places 41 and 42 two one-way valves have been provided. There need of course not be a common central strip at the passage places 41 and 42, but there can be two separate strips at these two places. Moreover, further seals can be made above the seal 55, so that further spaces of the same kind as spaces 56 and 57 will be obtained. At these further spaces, one-way valves of the same kind as those at the seals 50 and 55 can be arranged.

FIG. 29 shows an inner container 1′ according to FIG. 28, viewed from above, in which the two flaps 51 and 52 at one end of the container will be noted. At the opposite end there are two similar flaps. From FIG. 29 it will also be noted that the flap 52 has a seal 43 and a seal 44, and that the central strip is common for both of the flaps, and has been given the reference designation 40'. FIG. 28 and FIG. 29 are variants of each other in a certain respect, with consideration to the points of the flaps 51 and 52. In FIG. 28 the points have been cut off, and outlet openings 45 and 46 have then been created at the point of the flap and corresponding openings at the other three points. In FIG. 29, the points of the flaps are intact, and each central strip emerges adjacent to the points and either one-way valves or outlet openings are formed there, depending upon whether or not the exit is in a seal. The one-way valves at the different passage places can be positioned so that the gas which flows out has different directions in relation to each other. This is indicated in FIG. 28 at the passage places 41 and 42.

A container according to FIGS. 28 and 29 functions in the following way. It may be assumed, for instance, that the container is filled with coffee, and that there is a pressure inside the container in relation to the conditions prevailing outside of it. Owing to the pressure differential, the one-way valves are opened at the passage places 41 and 42, with the result that gas flows out through the opening 45. At the one-way valve at the passage place 41, which is nearest to the space for the goods, there is the risk that small particles will enter into the space formed and remain there, and prevent the valve from closing. Furthermore, the particles can pass through the valve, but owing to the direction of the valve they will be collected in the space 56, while the gas passes through the one-way valve at the passage place 42. No particles will go to the one-way valve at the passage place 42, as these have been collected in the space 56.

If a higher safety factor is desired, further closed spaces can be arranged above the weld 55.

In the foregoing description it has been assumed that the inner container, when placed in the outer casing, has been turned so that a smooth surface 5 of the inner container is always facing the part of the outer casing that constitutes the opening part of the container. A smooth cover panel is thereby obtained. However, it can sometimes be preferable to have other side surfaces of the inner container face the opening part of the container. This combination of inner and outer container is also included in the concept of the invention. In case a surface with a seal or closing flaps is facing the opening part, it will of course be more difficult to cut the cover panel.

It is also within the concept of the invention that the tube of which the inner container is formed is made of two or more foils which are sealed to each other so that the walls of the tube will have a number of longitudinal seals. Also in this embodiment, a smooth surface of the inner container can constitute its opening part.

It is moreover possible to make the inner container of a number of sheets of foil that can be pre-cut and which are sealed together in such a way that the inner container will obtain the above-mentioned properties.

We claim:

1. A storage and shipping carton comprising:

a container made of a form-retaining material and having an opening in one side;

a rim extending from the inner surface wall of the container adjacent to the side opening of the container;

a cover constituting part of the container and being movable into and out of a position covering said opening, said cover when in its covering position being in sealing engagement with said rim;

an inner liner for placing goods therein, said inner liner being made of pliable material and having a shape substantially matching the inner shape of the container, the inner liner including a surface portion substantially parallel to the side of the container including the opening and in registry with said opening; and fastening means fastening the liner at said surface portion to an inner surface of the container along a line adjacent to said opening in the container.

2. The carton according to claim 1 wherein said cover includes score lines for opening and tearing off the scored portion of the cover, said surface portion of the inner liner being fastened to the scored cover portion of the container to effect opening of the liner upon tearing off the second portion of the cover.

3. The carton according to claim 1 wherein said container has a tubular shape, said container opening being at one end thereof.

4. The carton according to claim 1 wherein said inner liner is fastened to inner wall surface portions along a peripheral line.

5. The carton according to claim 1 wherein said rim is a peripheral rim, and said inner liner is fastened to the lower side of the rim relative to said opening in the container.

6. The carton according to claim 1 wherein said container is a substantially rectangular container having in its inner wall surface a peripheral groove adjacent to the container side including said opening, and wherein a rectangular frame is secured to said surface portion of the liner framing the same, said frame being engaged with said groove.

7. The carton according to claim 1 wherein said surface portion is provided on its upper side with a protrusion engaging said cover of the container when the cover is in the position closing the container opening.

8. The carton according to claim 1 wherein said inner liner consists of a folded one-piece blank.

9. The carton according to claim 1 wherein said inner liner contains inert gas.

* * * * *